United States Patent [19]

van Biesen et al.

[11] Patent Number: 5,064,131

[45] Date of Patent: Nov. 12, 1991

[54] PAPER-MAKING MACHINE REELING OPERATION

[75] Inventors: Franciscus A. van Biesen; Christopher J. English, both of St. Catharines, Canada

[73] Assignee: Quebec and Ontario Paper Company Ltd., Thorold, Canada

[21] Appl. No.: 549,123

[22] Filed: Jul. 6, 1990

[30] Foreign Application Priority Data

Jun. 5, 1990 [CA] Canada ..... 2018289

[51] Int. Cl.[5] ..... B65H 19/30

[52] U.S. Cl. ..... 242/65; 242/56 R

[58] Field of Search ..... 242/65, 56 R, 75.1

[56] References Cited

U.S. PATENT DOCUMENTS

| | | | |
|---|---|---|---|
| 2,248,014 | 1/1939 | Roesen | 242/75.1 |
| 3,061,225 | 10/1962 | Huck | 242/75.1 |
| 4,189,105 | 2/1980 | Klinkhammer et al. | 242/56 R |
| 4,394,990 | 7/1983 | Kikdal et al. | 242/65 |
| 4,441,663 | 4/1984 | Welch et al. | 242/65 |
| 4,540,131 | 9/1985 | Ishii et al. | 242/65 |
| 4,695,004 | 9/1987 | Grossman et al. | 242/56 R |
| 4,711,404 | 12/1987 | Falk | 242/56 R |
| 4,729,522 | 3/1988 | Tafel et al. | 242/75.1 |
| 4,921,183 | 5/1990 | Saukkonen et al. | 242/56 R |
| 4,934,619 | 6/1990 | Snygg | 242/56 R |
| 4,951,892 | 8/1990 | Chaplin et al. | 242/65 |

*Primary Examiner*—Daniel P. Stodola
*Assistant Examiner*—John Q. Nguyen
*Attorney, Agent, or Firm*—Sim & McBurney

[57] ABSTRACT

A center-wind assist device is employed to improve the quality of jumbo rolls produced during the reeling operation of a paper-making machine. The device applies torque to the winding reel during initial formation of the roll.

8 Claims, 4 Drawing Sheets

PAPER-MAKING MACHINE REELING OPERATION

FIELD OF INVENTION

This invention relates to paper-making, more particularly to the reel up of paper reels.

BACKGROUND OF THE INVENTION

Paper-making is a multiple step operation, involving forming, pressing, drying and reeling. A paper web is formed from a stock slurry in the forming section and is pressed and dried to a final paper sheet, which then is reeled up into large rolls of paper.

Modern paper-making machines operate at high speed and economy of operation requires continuous production of paper sheet, so that the reeling operation must be able to switch smoothly from a fully-wound roll to an empty reel, with only a minimal loss of paper.

Reeling operations generally involve a driven reel drum, and a winding reel, or reel spool, which is driven by engagement with the paper sheet passing in contact with the reel drum. The winding reel usually is supported on rails during the reeling operation. Tension is provided to the paper sheet by running the driven reel drum faster than the speed of the previous section of the paper-making machine, while nip load is provided between the winding reel and the driven reel drum. The tension and nip load can be varied, within rather narrow limits, to produce rolls of paper with a desired tightness.

As one winding reel forms a paper roll, an empty winding reel is positioned adjacent but not engaging the driven reel drum upstream of the operating winding reel. As the operating winding reel grows in diameter, the empty winding reel is rotated to the same surface speed as the driven reel drum, by any suitable starting drive.

Support arms then move the empty winding reel into engagement with the paper web passing over the surface of the driven reel drum, and the paper web then is cut, so that the paper web then follows and is wound up on the empty winding reel, with little or no paper being lost in the changeover.

The paper roll, or jumbo, is removed from its support rails while the new winding reel is moved onto the support rails vacated by the paper roll. A new empty winding reel then is positioned upstream of the winding reel, to repeat the procedure.

As discussed above, tension and nip load are employed to produce rolls of paper with the desired degree of tightness. There are narrow limitations, however, since, if the tension and/or nip load are too low, then the jumbo roll is soft and prone to defects. If the tension is too high, a weak sheet breaks and paper-making machine production is stopped. If the nip load is too high, then the nip itself creates defects in the jumbo roll. Defects in jumbo rolls are highly undesirable and can lead to breaks during printing, which is highly inconvenient to the end-user.

Environmental considerations have lead to a recycling of a wide variety of paper products and the incorporation of recycled fiber in newsprint and other paper furnishes. The limitations referred to above with respect to conventional operations are particularly severe for newsprint containing large amounts of recycled fiber.

In particular, it has been noted that, in paper rolls formed from such materials, a zone adjacent each longitudinal end of the roll and immediately adjacent the winding reel surface tends to be soft and prone to give rise to defects, including crepe wrinkles and internal bursts. This has lead to the practice that, when the jumbo roll is rewound into smaller rolls for customer use, the portion adjacent the reel surface is discarded and recycled, thereby decreasing overall production.

A search in the facilities of the United States Patent and Trademark Office with respect to the present invention revealed the following U.S. Patents as the closest known prior art:

U.S. Pat. No. 2,248,014
U.S. Pat. No. 3,061,225
U.S. Pat. No. 4,729,522

It is noted that none of this prior art is concerned with the problem associated with handling a continuous paper web, as in the reeling operation of a paper-making machine. Rather each citation is concerned with a rewind device which processes a roll of paper in a batch operation.

In particular, U.S. Pat. No. 2,248,014 relates to an unwinding reel drive employing belts engaging the roll and a tension regulator for the unwinding roll by applying a braking force to the reel which is controlled by a speed regulator which compensates for changes in diameter.

U.S. Pat. No. 3,061,225 also relates to an unwinding mechanism, which also may be used for rewinding, which employs a belt drive. The patent describes a device for compensating for tension variations in the winding web. In addition, a supplementary torque is applied to the roll (via a pulley and belt), which causes that portion of the rewinding web closest to the spindle core tube to wind tightly around the tube. It is intended that the assist decrease with increasing diameter.

U.S. Pat. No. 4,729,522 also describes an unwinding device. The patent is directed to a mechanism for maintaining a constant web tension in the unreeling web. The tension is sensed and a roll-contacting belt is driven in response to the sensed tension. A positive drive means also is connected to the roll shaft in order to variably control the rotation of the roll responsive to the sensed tension. The belt is operated to control the tension in the web when the roll is larger while the positive drive means operates to control rotation of the roll when the roll is smaller.

Accordingly, this prior art describes a variety of devices which are employed in wind up and unwinding of rolls and which are intended to control web tension. None, however, is directed to the problems of a continuously-operating paper machine reeling operation nor the provision of a positive drive to the take-up reel during the initial stages of reel uptake, as required herein, and as detailed below.

SUMMARY OF INVENTION

The present invention is directed towards alleviating the problems found in conventional reeling operations with the jumbo rolls, in particular, the inability to obtain a uniformly tightly-wound paper roll, particularly with certain grades of paper, including those containing a high proportion of recycled fiber.

In the present invention, a centre-wind assist is provided to the empty winding reel not only to bring it up to the speed of the driven reel drum immediately before it commences to reel up paper but also during initial reeling of the roll, so as to apply torque to the core of the winding reel.

The application of torque in this way to the winding reel enables the desired roll tightness to be achieved, while excessive levels of tension and nip load are avoided.

Accordingly, in one aspect of the present invention, there is provided an improvement in a paper-making machine reeling section comprising driven reel means and means for moving a winding reel from a rest position adjacent to but not engaging the driven reel means and upstream, in the intended direction of paper web movement on the driven reel means, of a main winding position, through a contact position in engagement with the paper web and the driven reel means and to the main reeling position.

The improvement comprises centre wind assist means comprising belt means for engaging the winding reel to apply a driving torque thereto, driving means for the belt means, means for maintaining the belt means in driving relation to the winding reel at the rest position, during movement of the winding reel by the moving means from the rest position to the main winding position, and for a predetermined period of time in the main winding position, and means for retracting the belt means from the driving relation to a location to receive a further winding reel in its rest position.

While the applicants do not wish to be bound thereto, it is theorized that, since most newsprint machine reels are surface driven, this permits slip to occur at the reeling nip proportional to the amount of drag imposed by the non-driven spool by its bearings and weight. By driving the reel spool by the centre-wind assist device provided herein, particularly at the start of the roll, the drag effect is overcome until nip-induced tension is able to achieve the desired tight wind.

The applicants are aware of one commercial proposal for a centre-wind assist device, comprising a drive motor which couples with the spool, but only after it has effected a significant degree of reel up and has become located on the support rails. Not only is the rotational assist not available immediately from turn up, the most critical phase of operation, but a separate reel spool starter drive also is required.

DESCRIPTION OF PREFERRED EMBODIMENT

Referring first to FIGS. 1 to 4, there is shown therein a paper-making machine reeling section 10 which continuously reels up a paper web 12 into jumbo rolls 14. It is important to efficient paper-making machine operation that the reeling mechanism 10 be capable of continuously winding the paper web 12 into reels.

Figure 1:
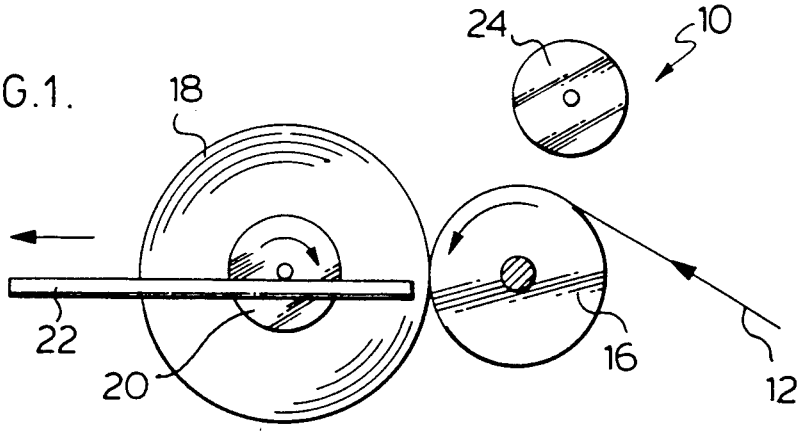
FIGS. 1 to 4 are schematic side elevational views of a paper machine reeling mechanism, illustrating the sequence of steps involved in reeling a paper web and changing over from one winding reel to the next.

FIG. 1 shows the reeling mechanism 10 during the majority of the reeling operation. As seen therein, the paper web 12 passes over the outer surface of a driven reel drum 16 and through the nip between the reel drum 16 and a growing paper roll 18 formed by winding on a reel spool 20 which is mounted on a pair of parallel side rails 22 for sliding movement as the diameter of the paper roll 18 increases.

The reel spool 20 and growing paper roll 18 thereon are rotated by the reel drum 16 by reason of the frictional engagement of the paper roll 18 with the reel drum 16. The reel drum 16 usually is driven at a speed faster than the previous section of the paper-making machine to ensure that the paper web 12 is under tension, so that the paper web is tightly wound on the reel spool 20.

An empty reel spool 24 is positioned upstream of the reel spool 20 in the direction of movement of the paper web 12 adjacent to but not in engagement with the paper web 12. During most of the reeling period, the empty reel spool 24 remains stationary. As the growing roll 18 increases in diameter, the spool 20 slides along the rail 22. During this time, rotation of the empty reel spool 24 is commenced until the spool 24 has achieved a surface speed the same as or at least approximately that of the driven reel drum 16.

Figure 2:
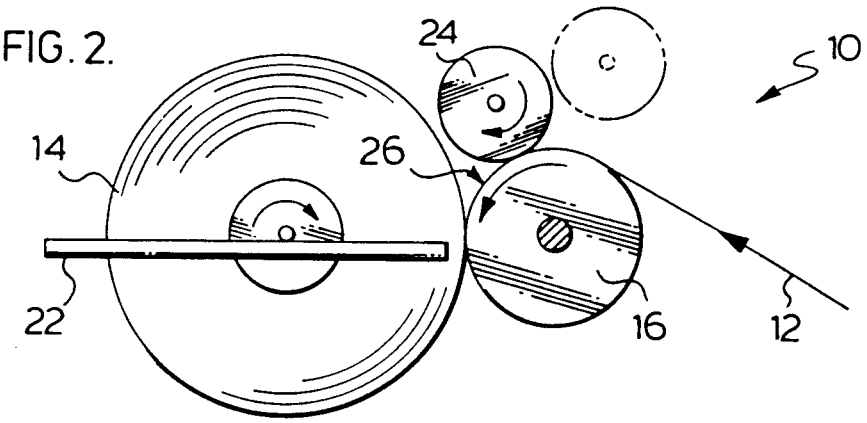

The empty reel spool 24 then is moved in an arcuate path, as seen in FIG. 2, into engagement with the outer surface of the paper web 12. In a conventional system, the start-up drive mechanism which commences rotation of empty reel spool 24 and brings it up to speed, as described above, ceases to impart rotational motion to the empty reel spool 24 as soon as the empty reel spool 24 commences its arcuate movement towards engagement with the paper web 24, so that the reel spool 24 is free-wheeling until coming into contact with the paper web 12, whereupon it becomes driven by the driven reel drum 16.

In contrast, as will be seen from the more detailed description below, in the present invention, driving torque is continued to be applied to the empty reel spool 24 both during the arcuate movement and subsequently.

Figure 3:
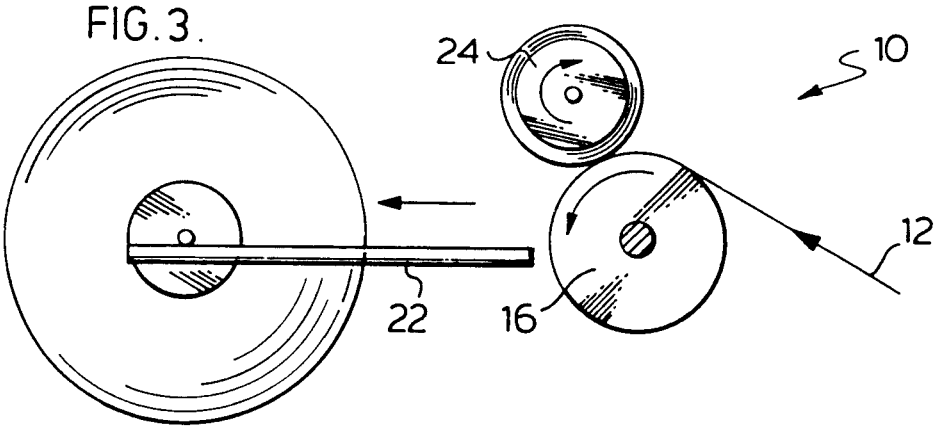

A web-severing device 26 is applied to the width of the paper web 12, so that the paper web then follows the surface of the reel spool 24 and the paper web is commenced to be wound on the reel spool 24. The jumbo roll 14 then is moved along the rails 22 out of the engagement with the driven reel drum 16 (FIG. 3). The jumbo roll 18 then is removed from the rails 22, for further processing, in accordance with customer requirements.

Once the jumbo roll 18 is out of the way, the reel spool 24 then is moved onto the rails 22 to be supported thereby while maintaining a nip between the driven reel drum 16 and the paper web 12. When the reel spool 24 is in engagement with the rails 22 (FIG. 4), the reel spool 24 becomes, in effect, the reel spool 20 in FIG. 1, with a growing paper roll 18 being formed thereon. A new empty reel spool 24 then is positioned adjacent to but not engaging the paper web 12, as in FIG. 1, ready to repeat the sequence.

This sequence of operations, illustrated substantially in FIGS. 1 to 4, of reel up of paper web to form a jumbo roll and change-over to an empty reel spool, is effected continuously, as long as paper web 12 is produced by the paper-making machine.

The applicants have found that, when this sequence of operations is effected, the jumbo rolls 14 tend to be less tightly wound in regions adjacent the longitudinal ends and the radial centre of the reel, leading to problems when the roll is used, particularly with a newsprint furnish which comprises a majority of recycled fiber.

Figure 5:
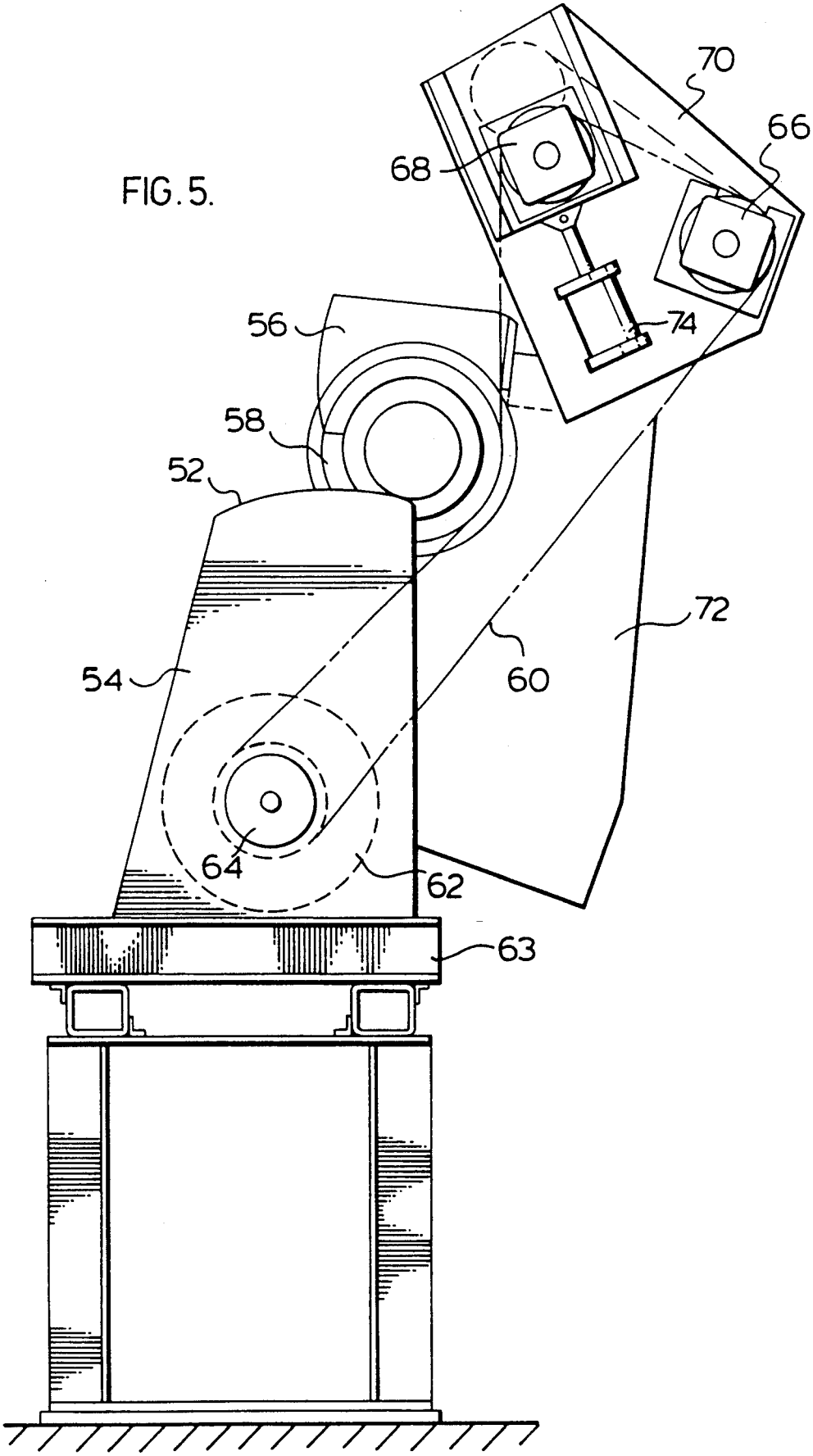
FIG. 5 is side elevational view of one embodiment of centre-wind assist device in accordance with one embodiment of the invention, in a first position.
Figure 6:
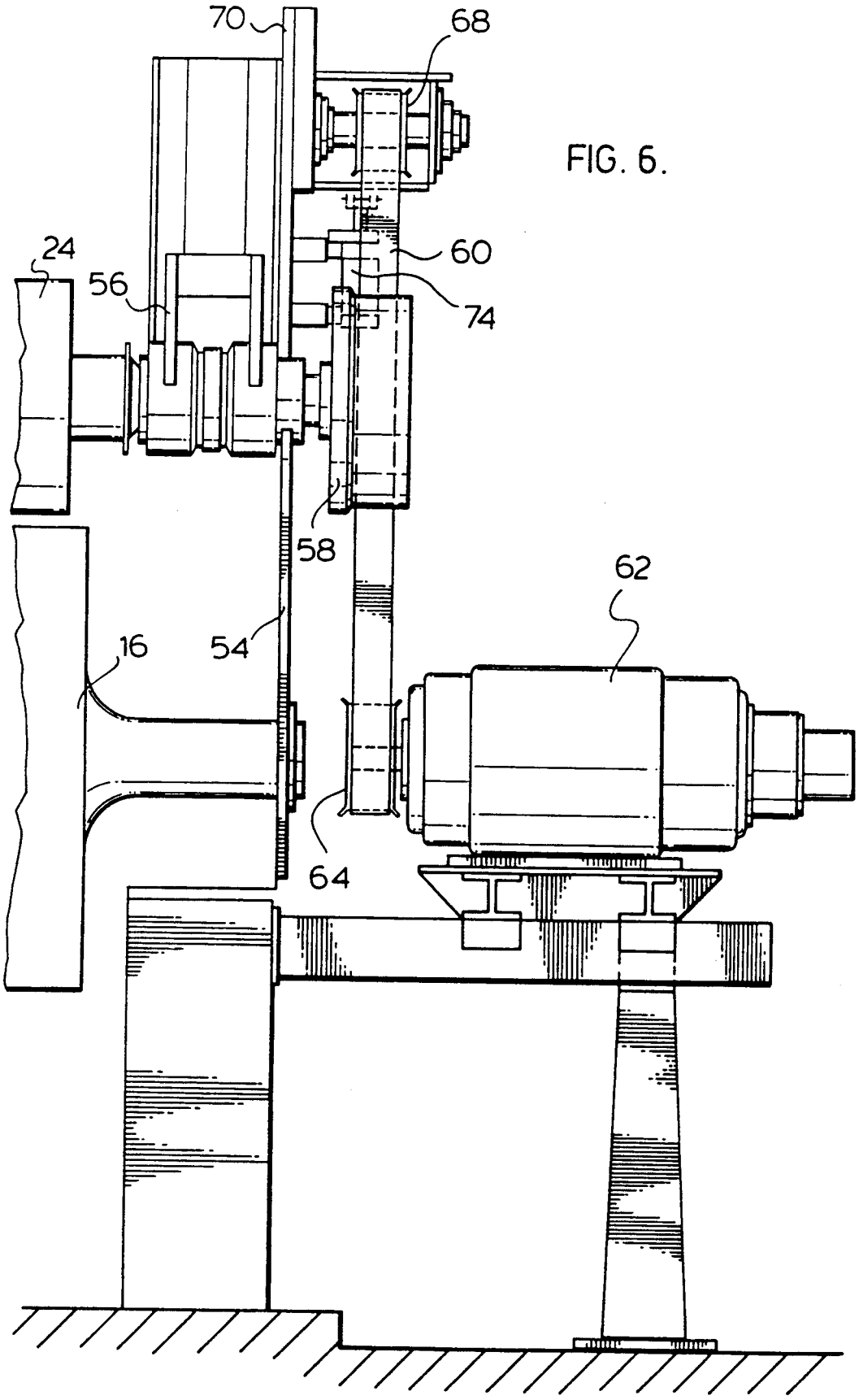
FIG. 6 is a front-elevational view of the centre-wind assist device of FIG. 5.
Figure 7:
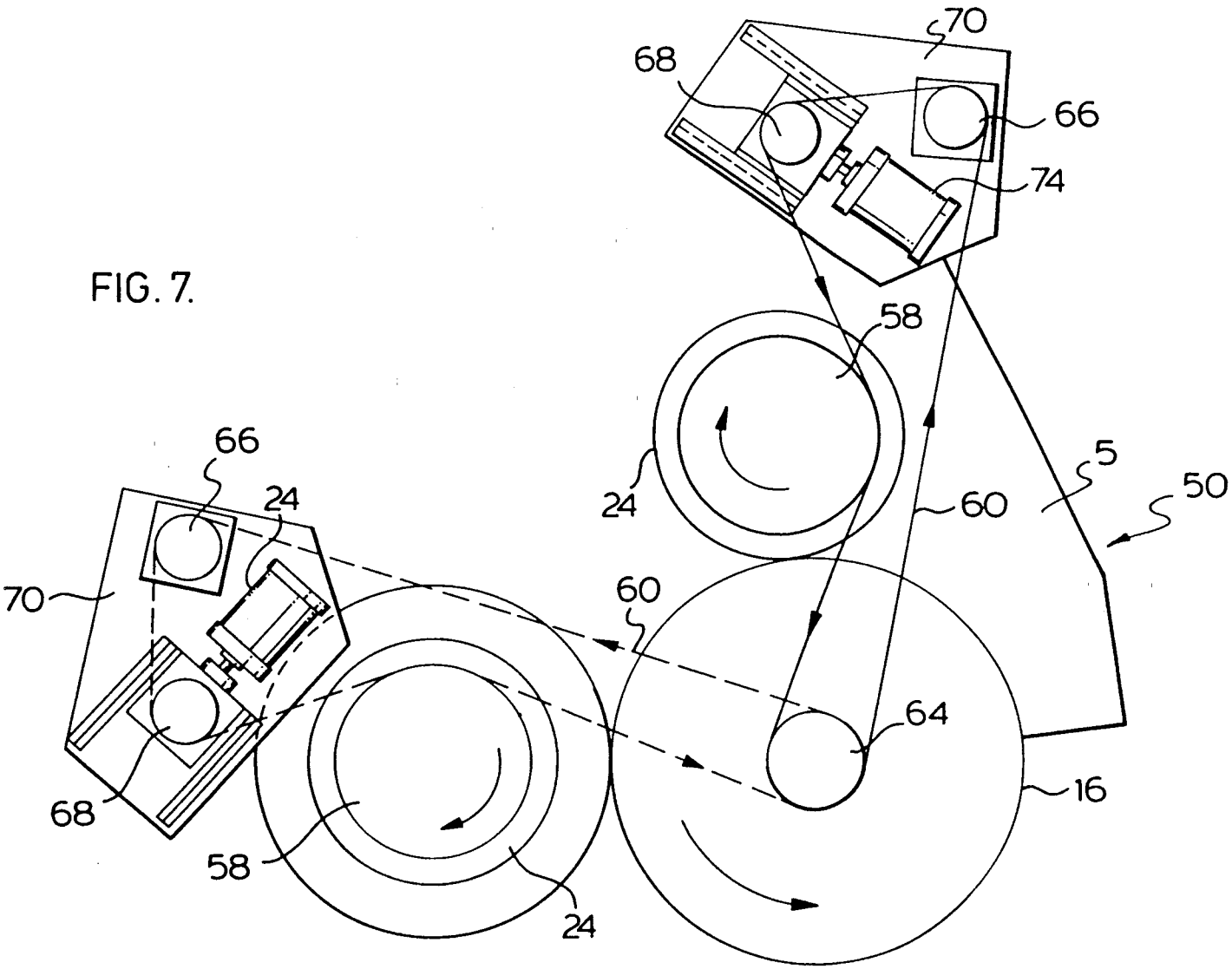
FIG. 7 is a composite side elevational view of the centre-wind assist device of FIG. 5 in second and third positions.

The present invention seeks to alleviate this problem by using a centre-wind assist device 50, one embodiment of which is illustrated in FIGS. 5 to 7.

Figure 4:
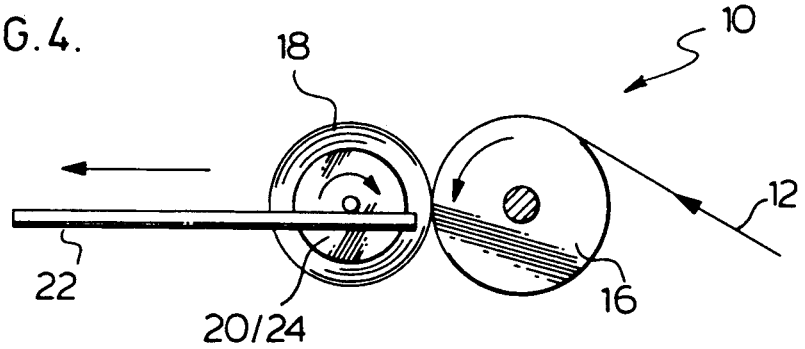

As seen thereon, the empty reel spool 24 is supported at each end on the curved upper surface 52 of a conventional upright flange 54 and is maintained in such contact by a primary arm 56 of conventional construction, which serves to grip and move the empty reel spool 24 as required. The empty reel spool 24 is gripped between the primary arm 56 and the outer surface 52 as the empty spool 24 is moved into engagement with the paper web 12 (FIG. 2) and then the primary arm 56 guides the reel spool 24 to contact with the support rails 22 in engagement with the driven reel drum 16 (FIGS. 3 and 4).

The empty reel spool 24 is provided with a brake drum 58 which has a portion of its surface grooved to receive complimentary-shaped sprockets in a belt 60, which is driven by a motor 62 mounted to a frame member 63, through drive pulley 64 having a grooved outer surface to accommodate the belt 60. The belt 60 also is trained about free-wheeling pulleys 66 and 68 mounted to a frame member 70, which itself is supported by a main frame member 72 of the primary arm 56 which is pivotally mounted about the axis of the drive pulley 64. The pulley 68 is mounted in sliding relation with the frame member 70 and is operably connected to a cylinder 74 to enable tension to be applied to and relieved from the belt 60.

The drive pulley 64 is mounted on the centre line of rotation of the primary arms 56, so that a constant drive geometry is maintained as the primary arms 56 rotate and as the roll grows in size. Very little take-up of the belt 60 is required as the roll builds up.

In operation, as the jumbo roll 14 grows in diameter, the motor 62 is activated to commence rotation of the empty reel spool 24 and to increase its surface speed to that of the driven reel drum 16. As the empty reel spool 24 is moved by the primary arm 56 into engagement with the outer surface of the paper web 12 (turn-up position), the main frame member 72 also pivots about the axis of the drive pulley 64, so that torque is continued to be applied to the reel spool 24 through the brake drum 58 (position A in FIG. 7).

As reeling commences on the reel spool 24, torque is continued to be applied to the reel spool 24 by the drive belt 60. When the reel spool 24 is moved into engagement with the rails 22, the main frame 72 pivots about its axis to maintain the driven relationship with the reel spool 24 (position B in FIG. 7).

The application of torque to the reel 20/24 is maintained until the roll has grown to a diameter beyond the observed fault region in the prior art, whereupon the primary arms 56 are retracted, thereby disengaging the drive belt 60, so that the spool 24 ceases to have torque applied by the drive motor 62. The centre-wind assist device 50 is returned to its original position (FIG. 5) by pivoting of the main frame member 72 about its axis as the primary arms 56 retract.

As the belt 60 ceases to engage the pulley 58, the resulting slack in the belt 60 is taken up by the sliding pulley 68. In the retracted position (FIGS. 4 and 5), the belt tension is automatically lowered, such that a new empty reel spool can be received ready to repeat the cycle.

The centre-wind assist device of the invention provides a number of benefits not previously attainable with a paper-making machine winding mechanism. The drive roll provides controlled torque input to the reel spool, resulting in improved wound-in-tension. Since the device is automatically engaged when a new spool is loaded into the machine, the centre-wind assist device serves to accelerate the spool to machine speed and replaces the existing reel spool starter.

The use of a timing drive belt ensures that the spool is at the correct speed before becoming engaged against the reel drum. The device of the invention does not interfere with the existing ease of transfer of spools between paper machine reel and winder. The drive belt automatically engages a new spool as it is loaded into the primary arm.

Drive controls may be provided associated with the motor 62 to permit decreasing, constant or increasing torque input to be applied to the winding reel 24, as required to obtain optimum wound-in tension.

The use of the tensioning device and cantilevered pulleys in association with the belt enables the drive belt to be changed very quickly, requiring virtually no disassembly and no belt splicing requirement.

SUMMARY OF DISCLOSURE

In summary of this disclosure, the present invention provides a modification to paper-making machine reeling procedures which enables improved control of jumbo roll quality to be achieved. Modifications are possible within the scope of the invention.

What we claim is:

1. In a paper-making machine reeling section comprising:

driving drum means, a winding reel, and means for moving said reel (i) from a rest position adjacent to but not engaging said driving drum means upstream, in the intended direction of paper web movement on said diving drum means, of a main winding position, (ii) through a contact position in engagement with the paper web and the driving drum reel means, and (iii) to the main winding position, the improvement which comprises:

centre wind assist means for applying a driving torque to said winding reel comprising:

(a) belt means for selectively engaging the winding reel in driving relation, (b) driving means for said belt means, (c) means for providing and maintaining said belt means in said driving relation to said winding reel (i) at said rest position, (ii) during movement of said winding reel by said moving means from said rest position through said contact position to said main winding position, and (iii) for a predetermined period of time in said main winding position, and (d) means for retracting said belt means from said driving relation to a location to receive a next winding reel in its rest position.

2. The reeling section of claim 1 wherein said centre wind assist means further comprises tensioning means operative to maintain said belt means under tension when in said driving relation to said winding reel.

3. The reeling section of claim 1 wherein said driving means for said belt means comprises motor drive means and a drive pulley engaging said belt means.

4. The reeling section of claim 3 wherein said belt means has a plurality of transverse sprockets therein, said pulley has complimentarily-shaped grooves engaging said belt sprockets, and said winding reel has a brake drum also with complementarily-shaped grooves engaging said belt sprockets when driven by said belt means.

5. The reeling section of claim 4 wherein said drive pulley is mounted for rotation on the centre-line of rotation of said means for moving said winding reel.

6. The reeling section of claim 5 wherein said centre wind assist means further comprises free-wheeling pulley means located remote from said drive pulley and about which said belt means is trained, said free-wheeling pulley means being mounted to said means for moving said winding reel.

7. The reeling section of claim 6 wherein said free-wheeling pulley means comprises a first fixed-position pulley means and a second movable-position pulley means and said centre wind assist means has tensioning cylinder means operatively connected to said movable-position pulley means for applying tension to said belt means through said movable-position pulley means.

8. The reeling section of claim 3 wherein said drive motor is controlled by drive controls to permit said drive motor to apply increasing, constant or decreasing torque to said winding reel.

* * * * *